US005372312A

United States Patent [19]

Vidusek

[11] Patent Number: 5,372,312

[45] Date of Patent: * Dec. 13, 1994

[54] AIR ATOMIZING SPRAY NOZZLE ASSEMBLY WITH ANGLED DISCHARGE ORIFICES

[75] Inventor: Daniel A. Vidusek, St. Charles, Ill.

[73] Assignee: Spraying Systems Co., Wheaton, Ill.

[ * ] Notice: The portion of the term of this patent subsequent to Jan. 5, 2010 has been disclaimed.

[21] Appl. No.: 110,371

[22] Filed: Aug. 23, 1993

[51] Int. Cl.[5] ..... B05B 7/04

[52] U.S. Cl. ..... 239/419.3; 239/432; 239/434; 239/428; 239/461; 239/104

[58] Field of Search ..... 239/104, 434, 432, 106, 239/461, 567, 490, 552, 553.5, 590.3, 590.5, 419.3, 428

[56] References Cited

U.S. PATENT DOCUMENTS

| | | | |
|---|---|---|---|
| 716,724 | 12/1902 | Lassoe et al. | 239/434 |
| 1,408,521 | 3/1922 | Lathrop | 239/490 |
| 1,598,996 | 9/1926 | Wheelock | 239/552 |
| 2,012,139 | 8/1935 | Peabody | 239/427 |
| 3,279,705 | 10/1966 | Stiefel | 239/490 |
| 3,452,933 | 7/1969 | Hakluytt | 239/567 |
| 3,730,438 | 5/1973 | Howe | 239/490 |
| 4,349,156 | 9/1982 | Haruch et al. | 239/432 |
| 4,591,099 | 5/1986 | Emory et al. | 239/434 |
| 4,815,665 | 3/1989 | Haruch | 239/434 |
| 5,176,325 | 1/1993 | Vidusek | 239/434 |

FOREIGN PATENT DOCUMENTS

| | | | |
|---|---|---|---|
| 0278115 | 8/1988 | European Pat. Off. | 239/434 |

*Primary Examiner*—Andres Kashnikow
*Assistant Examiner*—Christopher G. Trainor
*Attorney, Agent, or Firm*—Leydig, Voit & Mayer, Ltd.

[57] ABSTRACT

A spray nozzle assembly particularly adapted for directing a finely atomized slurry of hydrated lime for removing sulfur dioxide from flue gases. The nozzle assembly includes a nozzle body having a first pre-atomizing and mixing chamber into which pressurized liquid and air flow streams are directed for breaking down and pre-atomizing the liquid, an orifice plate at the downstream end of the first pre-atomization and mixing chamber for restricting the fluid flow into a second chamber defined by the orifice plate and spray tip, and a spray tip having a plurality of circumferentially spaced discharge orifices through which atomized liquid particles in the second chamber discharge. Each discharge orifice is inclined at a compound angle in order to cause the spray to discharge from the tip as a swirling annular curtain and thereby retard the build up of lime and fly ash on the tip.

15 Claims, 2 Drawing Sheets

AIR ATOMIZING SPRAY NOZZLE ASSEMBLY WITH ANGLED DISCHARGE ORIFICES

FIELD OF THE INVENTION

The present invention relates generally to spray nozzles, and more particularly, to spray nozzles of the type that are utilized for spraying lime slurries in gas desulfurization systems.

BACKGROUND OF THE INVENTION

It is known to spray slurries of hydrated lime into the discharging flue gases from coal powered furnaces or boilers, such as in electric power plants, for the purpose of capturing, reaction with, and removing sulfur dioxide from the gases prior to discharge to the atmosphere. To effectively scrub sulfur dioxide from such gases, it is necessary that the slurry be finely atomized into small liquid droplets. It also is desirable that spray particles be of such small size in order to enhance drying prior to impinging upon the flue duct work so as to prevent build-up and corrosion.

Vidusek U.S. Pat. No. 5,176,325 discloses a spray nozzle assembly which overcomes many of the problems of prior spraying systems in that the nozzle assembly of the patent is capable of effectively discharging a finely atomized slurry of hydrated lime with low air consumption requirements and with reduced wear to exposed surfaces of the nozzle. In some installations, however, lime and fly ash build up rather rapidly on the center portion of the exposed face of the nozzle tip and detrimentally affect the spraying action. Attempts to solve the build-up problem by shrouding the external portion of the tip or by directing a stream of shielding air around the tip are relatively expensive and have met with only limited success.

SUMMARY OF THE INVENTION

The general aim of the present invention is to provide a new and relatively inexpensive spray nozzle capable of discharging a finely atomized slurry of hydrated lime or the like without experiencing significant build-up of material on the nozzle tip.

A further object of the invention is to achieve the foregoing by providing a nozzle tip formed with uniquely angled discharge orifices which effect swirling of the spray emerging from the tip into an annular curtain to help prevent lime and other material from building up on the tip.

The invention also resides in inclining each discharge orifice at compound angles of such magnitude as to enable the orifices to produce effective swirling of the spray while permitting practical manufacture of the nozzle tip.

These and other objects and advantages of the invention will become more apparent from the following detailed description when taken in conjunction with the accompanying drawings.

Figure 1:
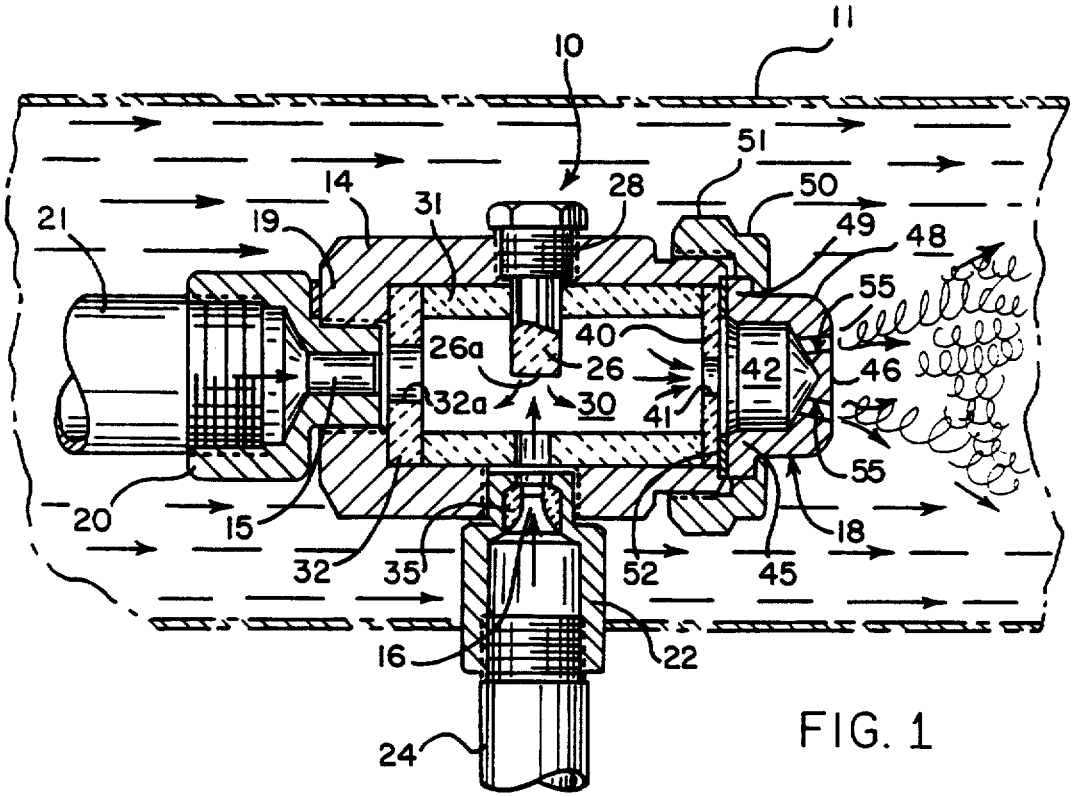
FIG. 1 is a vertical section showing one embodiment of a new and improved spray nozzle assembly incorporating the features of the invention.
Figure 6:
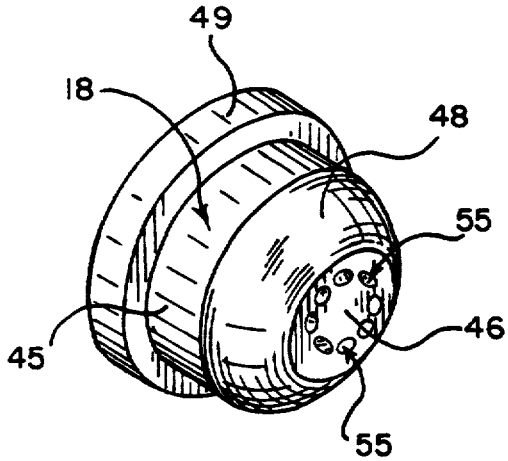
FIGS. 6 and 7 are enlarged front and rear perspective views, respectively, of the nozzle tip shown in FIG. 1.
Figure 7:
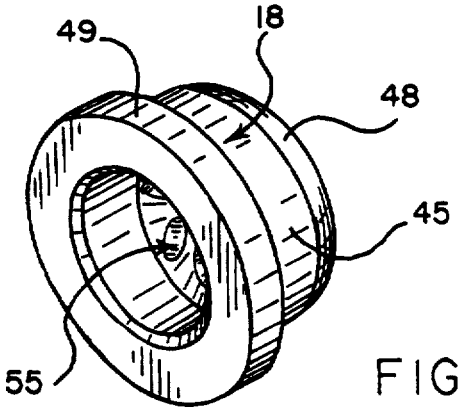
Figure 2:
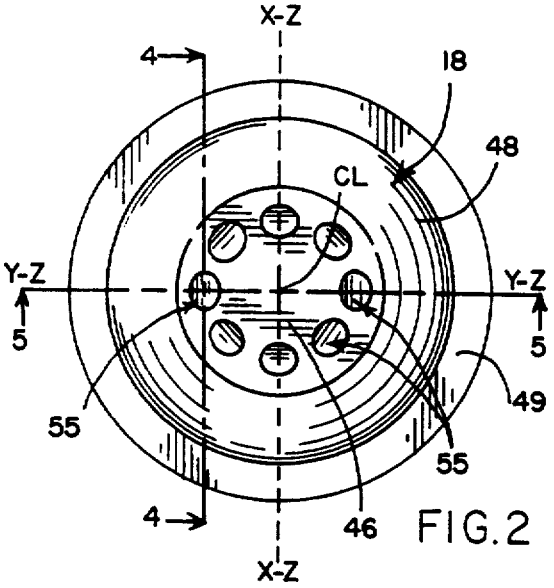
FIGS. 2 and 3 are enlarged front end and rear end views, respectively, of the nozzle tip shown in FIG. 1.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to the drawings, there is shown an illustrative spray nozzle assembly 10 embodying the present invention adapted for spraying lime slurries in a flue duct 11, such as the exhaust duct of a coal fueled boiler in a power plant, for the purpose of removing sulfur dioxide from the rising flue gases. The nozzle assembly 10 includes a cylindrical body 14 having an air inlet 15 at an upstream end thereof, a lime slurry or liquid inlet 16 located intermediate the ends of the body 14, and a tubular nozzle tip member 18 at the downstream end thereof. The nozzle body 14 in this case has an end wall 19 at its upstream end into which an adaptor 20 for a pressurized air supply line 21 is threadedly engaged. An adaptor 22 for a liquid or lime slurry supply line 24 threadedly engages an underside of the body 14 approximately midway between its ends. Pressurized air from the supply line 21 is directed longitudinally through the body 14 from the air inlet 15, which in this case is defined by the adaptor 20, while pressurized liquid is introduced into the body through the liquid inlet 16 at an angle perpendicular to the longitudinal axis of the body 14 and the moving air stream for converging with the air stream.

For enhancing atomization of the converging liquid and air flow streams, an impingement post 26 extends into the body 14 in opposed relation to the liquid inlet 16. The post 26 in this case is ceramic in order to minimize wear and is mounted on the end of a screw-in support member 28 threadedly engaged in an aperture on the top side of the body 14 for selected positioning. The post 26 has an impingement face **26*a* at the terminal end thereof, preferably positioned on the axis of the air inlet 15, against which liquid introduced into the body from the liquid inlet 16 impinges. At the same time, the pressurized air stream directed longitudinally through the body 14 from the air inlet 15 sweeps across the impingement face 26*a*** to further break down and pre-atomize the liquid into relatively small particles which are turbulently directed through the body in a downstream direction.

For defining a first pre-atomizing, mixing and expansion chamber 30 and for protecting the interior of the nozzle body 11 from abrasive wear of the turbulently moving lime slurry, the body 14 has a cylindrical liner 31 and an upstream end-plate 32 both preferably formed of non-erosive material, such as ceramic. The end-plate has a central aperture **32*a* slightly larger than the air inlet 15 so as not to impede the flow of pressurized air into the mixing chamber 30. The cylindrical liner 31 has a liquid inlet opening 33 coaxial with and slightly larger than the liquid inlet 16 for permitting free passage of the liquid flow stream into the mixing chamber 30 from the liquid inlet 16. To further minimize wear, the liquid inlet 16 is defined by a ceramic insert 35 disposed within the adaptor 22. The nozzle body 14 has a downstream orifice plate or end wall 40 preferably made of ceramic and formed with a relatively small diameter flow passageway 41. The orifice plate 40 and the nozzle spray tip 18 define a second mixing, atomizing and expansion chamber 42 distinct from the first chamber 30 whereby pre-atomized liquid particles in the first chamber are broken down further as they are directed through the small diameter flow passageway and impinge upon the walls of the second chamber prior to discharge from the spray tip. In the illustrated embodiment, the relatively small diameter flow passageway 42 is axially aligned with the air inlet 15, preferably sized similar to or slightly larger than the air inlet 15 and less than one-half the diameter of the mixing and expansion chamber 30**.

The spray tip 18 in this instance has a cylindrical side wall 45 and a flat end wall or discharge face 46 connected to the side wall by a rounded or curved corner section 48 to create a generally domed shape, the discharge face 46 being disposed in a radial plane extending perpendicular to the axis of the spray tip. The spray tip 18 has an outwardly extending flange 49 at its open upstream end to facilitate mounting of the tip 18 adjacent the downstream side of the orifice plate 40 by means of a retention cap 50 threaded onto an externally threaded downstream end of the body 14. The retention cap 50 preferably has a hex-shaped outer portion 51 to facilitate tightening and removal thereof by means of a wrench. An annular sealing gasket 52 is interposed between the nozzle body 14 and the spray tip 18.

While the theory of operation is not entirely understood, it is believed that the orifice plate 40 maintains a sufficiently large pressure differential between the first and second chambers 30, 42 such that the turbulently moving pre-atomized liquid particles within the first chamber 30 are caused to be directed through the relatively small diameter flow passage 41 in the orifice plate 40 at sufficient speed and force to cause shearing and further particle breakdown during entry into the second chamber 42 and upon impingement against the walls of the second chamber. Moreover, such further atomization has been achieved by the orifice plate 40 with reduced air flow requirements, thereby enabling lower capacity and less expensive pressurized air supplies.

In accordance with the present invention, circumferentially spaced discharge orifices 55 are formed through the spray tip 18 and are angled not only to cause a plurality of circumferentially spaced streams of finely atomized liquid particles discharged from the tip to initially form a generally hollow cone spray pattern, but also to effect swirling of the spray as an annular curtain in order to protect the exposed portions of the tip—and particularly the central discharge face 46 thereof—and thereby retard the build-up of lime, fly ash and the like on the tip. As a result, the service life of the tip is increased significantly since the lack of accumulation of lime and the like enables the tip to effectively discharge spray particles in a desired pattern over a longer period of time.

Figure 5:
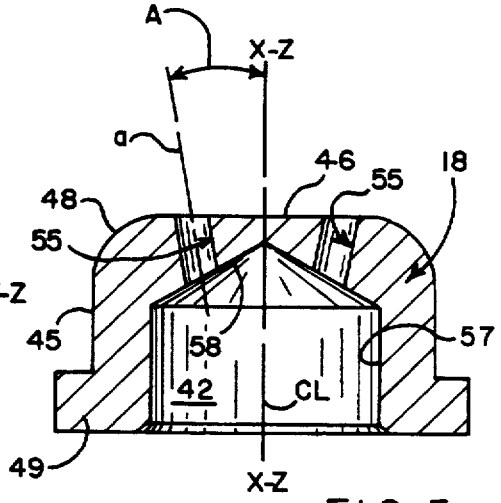

In the preferred embodiment, the spray tip 18 includes eight discharge orifices 55, which are formed through the flat discharge face 46 and which are spaced equally and circumferentially around a circle whose center lies on the longitudinally extending axis or centerline CL (FIG. 5) of the tip. Each orifice is formed by a drill (not shown) having a diameter ranging from about 3/32" to ⅛" and includes an axis a which is angled in a compound manner. Referring to FIG. 5, the axis a of each orifice is inclined at an acute angle A of about 10 degrees relative to a plane X-Z which contains the centerline CL, each axis being inclined in such a direction that it diverges away from the centerline upon progressing from the open upstream end of the spray tip toward the closed downstream end thereof. As a result, the orifices flare outwardly as they progress downstream and thus cause the finely atomized liquid particles to be initially discharged in the form of a hollow cone spray curtain. As the spray proceeds further from the nozzle tip, the streams of particles quickly drift and intermingle into a substantially continuous full cone pattern thereby forming a cloud of fine liquid particles for effectively capturing and reacting with sulfur dioxide in the flue gases.

In carrying out the invention, the build-up of lime, fly ash and the like on the central discharge face 46 of the tip 18 is reduced significantly by further angling the orifices 55 in such a manner as to cause the orifices to effect a turbulent spinning or swirling of the annular curtain as the spray is discharged from the tip. For this purpose, the axis a of each orifice is inclined at an acute angle B (FIG. 5) of about 35 degrees relative to a plane Y-Z disposed perpendicular to the plane X-Z. The angles A and B are selected to position the upstream entrance ends of the orifices as far inwardly as possible while staying consistent with accepted drilling techniques and not penetrating the side wall 45.

Figure 3:
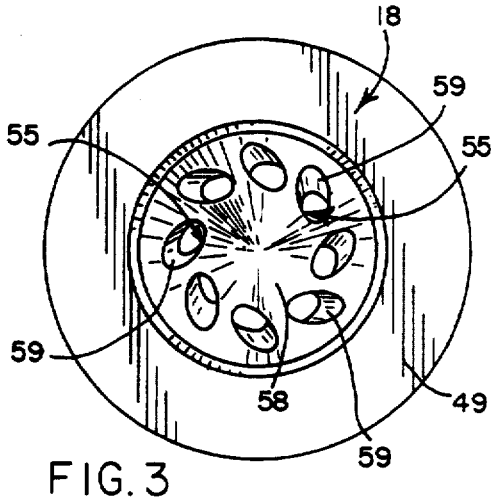
Figure 4:
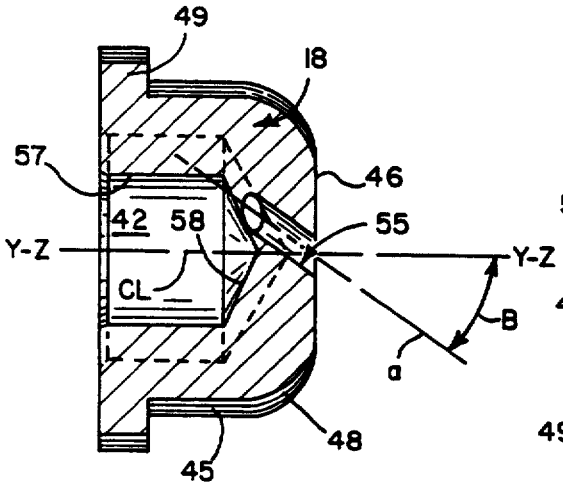
FIGS. 4 and 5 are cross-sections taken substantially along the lines 4—4 and 5—5, respectively, of FIG. 2.

As shown in FIGS. 4 and 5, the chamber 42 includes a cylindrical upstream portion 57 and a conical downstream closed end surface 58. By virtue of the drill for each orifice 55 lying along the inclined axis a and by virtue of the conical shape of the end surface 58, the downstream exit end of each orifice extends somewhat tangentially of the circle circumscribed by the orifices and, in addition, the upstream entrance end of each orifice is formed with a somewhat teardrop-shaped runout 59 at the end surface 58 as shown in FIG. 3. Due to this configuration, a rotational spinning action is imparted to the spray as the spray flows through the orifices. The spinning or swirling spray prevents or substantially reduces the build-up of deposits on the discharge face 46 of the tip 18 and helps prevent the formation of a "beard" of material. It is believed that the build-up is reduced by virtue of the spray discharge preventing entrance into the spray pattern of flue gas which can otherwise react with the discharging spray particles and accumulate on the discharge face 46 of the spray tip. Tests have demonstrated that the discharge face 46 of the present tip 18 remains shiny and uncoated after 45 minutes of use whereas prior tips of the type disclosed in the aforementioned patent experience coacting and build-up when operated for the same period of time under the same conditions.

It should be noted that the angles A and B are such that the upstream entrance ends of the orifices 55 are spaced sufficiently far from the centerline CL of the tip 18 as to leave, on the conical interior 58 of the tip, an uninterrupted impingement face whose diameter is larger than the orifice 41 in the plate 40. Accordingly, thorough atomization of the liquid occurs as a result of the liquid emerging from the orifice 41 striking the impingement face before being discharged through the orifices 55.

Figure 8:
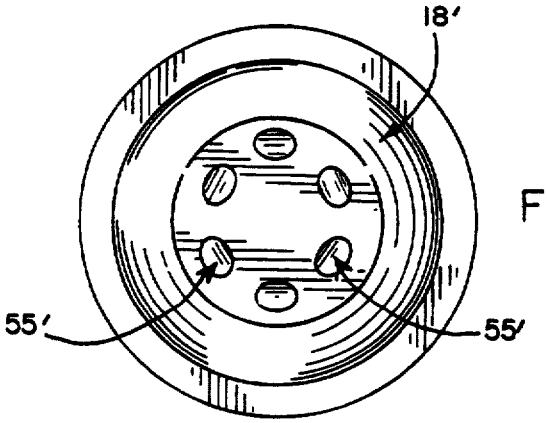
FIG. 8 is a view similar to FIG. 2 but shows a modified nozzle tip.

FIG. 8 shows a modified tip 18' which is formed with only six orifices 55'. While the modified tip 18' is somewhat less expensive to produce, more build-up occurs as compared to the eight-orifice tip 18 due to the relatively wide circumferential spacing between the orifices 55' allowing flue gas to penetrate the curtain of spray and move into proximity to the tip.

I claim:

1. A spraying system for removing sulfur dioxide from flue gases comprising a flue through which gases containing sulfur dioxide are directed, a nozzle assembly including a means defining a pre-atomizing and mixing chamber, means for directing a pressurized air stream into said chamber, means for directing a liquid stream of lime slurry into said chamber which with the assistance Of said pressurized air stream is broken down into pre-atomized liquid particles, a spray tip downstream of said pre-atomizing and mixing chamber into which pre-atomized liquid particles are directed, said spray tip having a central axis defining a longitudinal centerline, said spray tip having an end wall defining an internal impingement surface area at a downstream end thereof against which pre-atomized liquid particles are directed, said spray tip having a plurality of discharge orifices disposed about said impingement surface area through which atomized liquid particles discharge into said flue as a spray, each said orifice having an axis inclined at a predetermined acute angle A relative to a first plane containing said centerline and inclined so as to diverge away from said centerline upon progressing from an internal upstream side of said end wall toward an external downstream side thereof, and the axis of each orifice being inclined at a predetermined acute angle B relative to a second plane disposed perpendicular to said first plane, the inclination of the axes of said orifices causing spray to be discharged from said tip in the form of a swirling annular curtain so as to substantially minimize the build up of solids from the slurry and flue gases on an external side of said end wall.

2. The spraying system as defined in claim 1 in which said angle A is approximately 10 degrees.

3. The spraying system as defined in claim 1 in which said angle B is approximately 35 degrees.

4. The spraying system as defined in claim 1 in which said angles A and B are approximately 10 degrees and 35 degrees, respectively.

5. The spraying system as defined in claim 1 in which said member is formed with six equally spaced discharge orifices.

6. The spraying system as defined in claim 1 in which said member is formed with eight equally spaced discharge orifices.

7. The spraying system as defined in claim 1 in which said impingement surface is formed with a substantially conical surface.

8. A spray nozzle assembly comprising a nozzle body defining a first pre-atomization and mixing chamber, means defining an air inlet orifice through which a pressurized air stream is directed into said first chamber, means defining a liquid inlet orifice through which a pressurized liquid stream is directed into said first chamber and, with the assistance of said pressurized air stream, is broken down into pre-atomized liquid particles, an end wall at a downstream end of said first chamber formed with a reduced diameter orifice, a spray tip on an end of said body and comprising a tubular member of circular cross-section and having a longitudinal centerline, said tip member and said end wall defining a second atomizing and mixing chamber into which, said pre-atomized liquid particles from said first chamber are directed via said end wall orifice, said tip member having an open upstream end and having a closed downstream end defining an uninterrupted end wall impingement surface area in axial alignment with and of larger area then said reduced diameter orifice against which said pre-atomized liquid particles passing through said reduced diameter orifice are directed, said spray member having a plurality of discharge orifices disposed about said uninterrupted impingement surface area through which atomized liquid particles in said second chamber discharge as finely atomized particles, said discharge orifices being formed through said closed end of said tip member and being spaced equally in a circular pattern around said centerline, each discharge orifice having an axis inclined at a predetermined acute angle A relative to a first plane containing said centerline and inclined so as to diverge away from said centerline upon progressing from the upstream end of said tip member toward the downstream end thereof, and the axis of each discharge orifice being inclined at a predetermined acute angle B relative to a second plane disposed perpendicular to said first plane, the inclination of said axes causing spray to be discharged from said tip member in the form of a swirling annular curtain.

9. A spray nozzle assembly as defined in claim 8 further including an impingement member extending into said first chamber against which liquid introduced into said first chamber from said liquid inlet orifice impinges.

10. A spray nozzle assembly as defined in claim 8 in which said angles A and B are approximately 10 degrees and 35 degrees, respectively.

11. A spray nozzle assembly as defined in claim 8 in which said downstream end of said tip member is formed with a substantially flat discharge face disposed in a radial plane extending perpendicular to said centerline, said discharge orifices being formed through said discharge face, the downstream end portion of said tip member being formed with a substantially conical interior surface located immediately upstream of said discharge face and defining said uninterrupted impingement surface area.

12. A spraying system for removing sulfur dioxide from flue gases comprising a flue through which gases containing sulfur dioxide are directed, a nozzle assembly including a nozzle body which defines a first pre-atomizing and mixing chamber, means for directing a pressurized air stream into said first chamber, means for directing a liquid stream of lime slurry into said first chamber which with the assistance of said pressurized air stream is broken down into pre-atomized liquid particles, an end wall at a downstream end of said first chamber formed with a reduced diameter orifice, a spray tip on an end of said body, said spray tip and end wall defining a second atomizing and mixing chamber having a central axis defining a longitudinal central line of said spray tip into which pre-atomized liquid particles from said first chamber are directed via said end wall orifice, said spray tip having an end wall impingement surface area in axial alignment with said reduced diameter orifice against which pre-atomized liquid particles passing through said reduced diameter orifice are directed, said spray tip having a plurality of discharge orifices disposed about said impingement surface area through which atomized liquid particles in said second chamber discharge into said flue as a spray, each said orifice having an axis inclined at a predetermined acute angle A relative to a first plane containing said centerline and inclined so as to diverge away from said centerline upon progressing in a downstream direction through said spray tip, and the axis of each orifice being inclined at a predetermined acute angle B relative to a second plane disposed perpendicular to said first plane, the inclination of the axes of said orifices causing spray to be discharged from said tip in the form of a swirling annular curtain.

13. The spray nozzle assembly of claim 12 in which said end wall is defined by an orifice plate mounted at a downstream end of said nozzle body.

14. The spray nozzle assembly of claim 12 in which said liquid inlet orifice directs liquid at an angle of about 90 degrees to a longitudinal axis of said nozzle body.

15. The spray nozzle assembly of claim 12 including an impingement member extending into said first chamber against which liquid introduced into said first chamber from said liquid inlet orifice impinges.

* * * * *